US010427824B2

(12) United States Patent
Matsunami

(10) Patent No.: US 10,427,824 B2
(45) Date of Patent: Oct. 1, 2019

(54) BEVERAGE BOTTLE

(71) Applicant: VIEWTEC JAPAN CO., LTD., Kawasaki-shi, Kanagawa (JP)

(72) Inventor: Noboru Matsunami, Kawasaki (JP)

(73) Assignee: Viewtec Japan Co., Ltd., Kanagawa (JP)

( * ) Notice: Subject to any disclaimer, the term of this patent is extended or adjusted under 35 U.S.C. 154(b) by 0 days.

(21) Appl. No.: 15/551,467

(22) PCT Filed: Feb. 18, 2015

(86) PCT No.: PCT/JP2015/054373

§ 371 (c)(1),
(2) Date: Aug. 16, 2017

(87) PCT Pub. No.: WO2016/132469

PCT Pub. Date: Aug. 25, 2016

(65) Prior Publication Data

US 2018/0029740 A1 Feb. 1, 2018

(51) Int. Cl.
*B65D 1/02* (2006.01)
*B65D 21/08* (2006.01)

(52) U.S. Cl.
CPC ..... *B65D 1/0292* (2013.01); *B65D 1/02* (2013.01); *B65D 21/08* (2013.01);
(Continued)

(58) Field of Classification Search
CPC ..... B65D 1/0292; B65D 2501/0027; B65D 1/02; B65D 1/0223; B65D 2501/0036;
(Continued)

(56) References Cited

U.S. PATENT DOCUMENTS 216,227 A * 6/1879 Sedgwick ..... 215/11.3
5,209,372 A * 5/1993 Norwood ..... B65D 1/0292 215/11.3

(Continued)

FOREIGN PATENT DOCUMENTS

JP H09-301371 A 11/1997
JP H11-342948 A 12/1999

(Continued)

*Primary Examiner* — Shawn M Braden

(74) *Attorney, Agent, or Firm* — Carrier Blackman & Associates, P.C.; Joseph P. Carrier; Anne G. Sabourin

(57) ABSTRACT

Provided is a beverage bottle capable of keeping a carbonated beverage left over therein from going flat. The beverage bottle is provided with a bottle body having a volume-reducing structure capable of reducing the volume of the bottle body, a cap capable of sealing an opening of the bottle body, and a shrunken state-maintaining means provided on the bottle body to cause the bottle body having been reduced in volume to be maintained in the reduced volume state. The volume-reducing structure is configured of helical protrusions and recesses respectively formed on the bottle body, and the shrunken state-maintaining means is provided on a trunk section of the bottle body and is configured with a squeezing means for squeezing and maintaining the trunk section having been narrowed by being squeezed along the helical protrusions and recesses.

1 Claim, 4 Drawing Sheets

(52) U.S. Cl.
CPC ..... *B65D 2501/0018* (2013.01); *B65D 2501/0027* (2013.01); *B65D 2501/0036* (2013.01)

(58) Field of Classification Search
CPC ..... B65D 21/08; B65D 37/00; B65D 1/0207; B65D 23/00; B65D 1/44
See application file for complete search history.

(56) References Cited

U.S. PATENT DOCUMENTS

| | | | | |
|---|---|---|---|---|
| 5,562,221 | A * | 10/1996 | Beniacar | B65D 1/0292 215/386 |
| 2010/0314284 | A1 | 12/2010 | Truesdale | |
| 2013/0048593 | A1* | 2/2013 | Jung, II | B65D 23/04 215/382 |
| 2013/0075393 | A1 | 3/2013 | Haynie | |

FOREIGN PATENT DOCUMENTS

| | | | |
|---|---|---|---|
| JP | 2000-153821 | A | 6/2000 |
| JP | 2003-312624 | A | 11/2003 |
| JP | 2004-083119 | A | 3/2004 |
| JP | 2010-513158 | A | 4/2010 |
| JP | 3174437 | U | 3/2012 |
| JP | 2015-037951 | A | 2/2015 |
| WO | 99/056454 | A2 | 11/1999 |
| WO | 2002/024531 | A1 | 3/2002 |

* cited by examiner

BEVERAGE BOTTLE

TECHNICAL FIELD

This invention relates to a beverage bottle, more specifically, a beverage bottle such as a synthetic resin-made bottle (chiefly a PET bottle) which is capable of keeping a carbonated beverage left over therein from going flat.

BACKGROUND ARTS

As for a beverage bottle designed for keeping a leftover carbonated beverage from going flat, it is conventionally known that there is a PET bottle having a trunk section formed in the shape of a bellows (3), wherein when a carbonated beverage is left over in the bottle, the bellows (3) is shrunken in accordance with the amount of leftover carbonated beverage, and thereafter, the bottle is sealed by a cap (1) in state where the bellows is shrunken, as disclosed in a patent document 1, for instance.

According to the PET bottle of this type, a misunderstanding arises such that it seems as if the PET bottle is capable of keeping the leftover carbonated beverage from going flat. As a matter of fact, the above patent document 1 contains a description to the effect that the PET bottle is capable of keeping the leftover carbonated beverage from going flat.

However, the PET bottle disclosed in the above patent document 1 fails to keep the leftover carbonated beverage from going flat.

This is because an action of merely sealing the bottle by the cap (1) with the bellows (3) shrunken in accordance with the amount of leftover carbonated beverage brings about a phenomenon in which carbon dioxide is released freely from the leftover carbonated beverage, and accordingly, the bottle comes to be returned to the original state (or the state in which the bellows (3) is expanded) by the thus released carbon dioxide.

Alternatively, a carbon dioxide divergence preventing device for a carbonated beverage in a PET bottle is also conventionally known, which has two holding plates (2) connected with each other by a hinge (1), a squeezing belt (3) fixed to one holding plate (2), and a slit-shaped through hole (4) provided in the tip of the other holding plate (2) to permit the squeezing belt (3) to pass through, as disclosed in a patent document 2, for instance.

The carbon dioxide divergence preventing device of this type allows the PET bottle to be maintained in the squeezed state in accordance with the amount of leftover carbonated beverage, and is therefore capable of keeping the leftover carbonated beverage from going flat.

However, it is inconvenient to use the carbon dioxide divergence preventing device in places other than home, because, in order to do so, there is the need for carrying this device.

REFERENCE LITERATURES IN THE RELATED ARTS

Patent Documents

Patent document 1: Publication of Japanese Unexamined Patent Application No. 2000-153821

Patent document 2: Publication of Japanese Unexamined Patent Application No. 2004-83119

SUMMARY OF THE INVENTION

Problems to be Solved by the Invention

An object of the present invention is to provide a beverage bottle which is capable of keeping a carbonated beverage left over therein from going flat.

Means for Solving the Problems

To solve the above problems, the present invention provides a beverage bottle which comprises a bottle body having a volume-reducing structure capable of reducing the volume of the bottle body, a cap capable of sealing an opening of the bottle body, and a shrunken state-maintaining means provided on the bottle body to cause the bottle body having been reduced in volume to be maintained in the reduced volume state.

According to the beverage bottle of the present invention, when a beverage is left over therein, the bottle body is shrunken by the volume-reducing structure in accordance with the amount of leftover beverage, the opening is then sealed by the cap, and thereafter, the bottle body having been changed to the shrunken state is maintained in the reduced volume state by the shrunken state-maintaining means provided on the bottle body.

Therefore, when the leftover beverage belongs to a group of carbonated beverages, the beverage bottle of the present invention is capable of keeping a leftover carbonated beverage from going flat.

Further, the beverage bottle of the present invention allows the amount of contact of the leftover beverage with air to be reduced, and is therefore also capable of keeping the leftover beverage from deterioration of the tastes thereof.

Besides, since the bottle body itself has the shrunken state-maintaining means, there is neither need for separately preparing any special instrument therefor nor need for carrying it, unlike the conventional art as disclosed in the above patent document 2.

There may be provided the beverage bottle of the present invention, wherein the volume-reducing structure is configured of helical protrusions and recesses respectively formed on the bottle body, and the shrunken state-maintaining means is provided on a trunk section of the bottle body and is configured with a squeezing means for squeezing and maintaining the trunk section having been narrowed by being squeezed along the helical protrusions and recesses.

With such a configuration, it is made possible to maintain the bottle body in the reduced volume state by a simple squeezing structure, while easily causing the bottle body to be shrunken by a squeezing action.

Alternatively, there may be provided the beverage bottle of the present invention, wherein the volume-reducing structure is configured by forming at least the trunk section of the bottle body in a bellows shape, and the shrunken state-maintaining means is configured with a plural number of mutually engageable hooks respectively provided on the angle-part tips of the bellows-shaped section.

With such a configuration, only an action of shrinking the bottle body along the bellows-shaped section enables the bottle body to be maintained in the reduced volume state in such a manner that the hooks are engaged with each other at the same time that the bottle body is shrunken, and as a result, any additional operation for maintaining the shrunken state is eliminated.

Alternatively, there may be provided the beverage bottle of the present invention, wherein the volume-reducing structure is configured of helical protrusions and recesses respectively formed on the bottle body, and the shrunken state-maintaining means is configured with hooks capable of being engaged with each other at the time when the bottle body is squeezed along the helical protrusions and recesses.

With such a configuration, only an action of squeezing the bottle body along the helical protrusions and recesses enables the bottle body to be maintained in the reduced volume state in such a manner that the hooks are engaged with each other at the same time that the bottle body is shrunken, and as a result, any additional operation for maintaining the shrunken state is eliminated.

MODE FOR EMBODYING THE INVENTION

Figure 1:
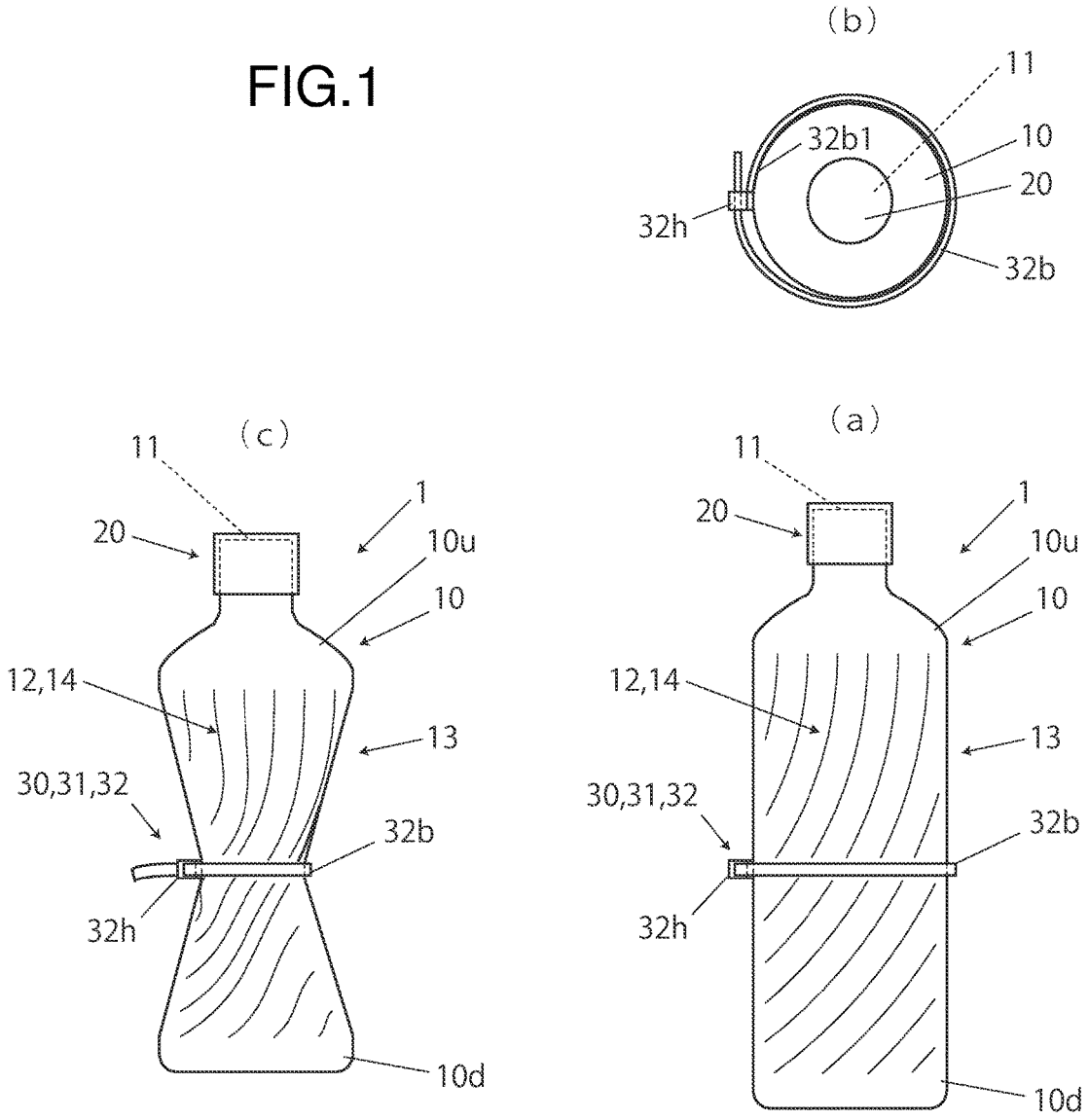
FIG. 1 is a view showing one embodiment of a beverage bottle according to the present invention, wherein FIG. 1(*a*) is a front view, FIG. 1(*b*) is a plan view, and FIG. 1(*c*) is a side view for explaining an action.

Hereinafter will be described embodiments of a beverage bottle according to the present invention with reference to the attached drawings. Referring to each drawing, it is noted that like reference characters designate like or corresponding parts throughout.

A beverage bottle 1 shown in FIG. 1 has a bottle body 10 having a volume-reducing structure 12 capable of reducing the volume of the bottle body 10, a cap 20 capable of sealing an opening 11 of the bottle body 10, and a shrunken state-maintaining means 30 provided on the bottle body 10 to cause the bottle body 10 having been reduced in volume to be maintained in the reduced volume state.

According to the illustrated beverage bottle 1, when a beverage is left over therein, the bottle body 10 is shrunken by the volume-reducing structure 12 in accordance with the amount of leftover beverage, the opening 11 is then sealed by the cap 20, and thereafter, the bottle body 10 having been changed to the shrunken state is maintained in the reduced volume state by the shrunken state-maintaining means 30 provided on the bottle body 10, as shown in FIG. 1(*c*).

Therefore, when the leftover beverage belongs to a group of carbonated beverages, the beverage bottle of the present invention is capable of keeping a leftover carbonated beverage from going flat.

Further, the beverage bottle of the present invention allows the amount of contact of the leftover beverage with air to be reduced by decreasing the amount of air remaining in the bottle, and is therefore also capable of keeping the leftover beverage from deterioration of the tastes thereof.

Besides, since the bottle body 10 itself has the shrunken state-maintaining means 30, there is neither need for separately preparing any special instrument therefor nor need for carrying it, unlike the conventional art as disclosed in the above patent document 2.

Referring to FIG. 1, there is provided the beverage bottle 1, wherein the volume-reducing structure 12 is configured of helical protrusions and recesses 14 respectively formed on the bottle body 10. The shrunken state-maintaining means 30 is provided on a trunk section 13 of the bottle body 10 and is configured with a squeezing means 31 for squeezing and maintaining the trunk section 13 having been narrowed by being squeezed along the helical protrusions and recesses 14.

With such a configuration, it is made possible to maintain the bottle body 10 in the reduced volume state by a simple squeezing structure, while easily causing the bottle body 10 to be shrunken as shown in FIG. 1(*c*) by a squeezing action with up and down sections 10*u*, 10*d* thereof held by the hands.

The bottle body 10 may be made of a synthetic resin (or PET (polyethylene terephthalate), for instance).

The volume-reducing structure (or the helical protrusions and recesses as for the volume-reducing structure shown in FIG. 1) 12 may be formed at the same time as forming of the bottle body 10.

The squeezing means 31 may be configured by fixing a tie-wrap 32, specifically, a portion 32*b*1 (see FIG. 1(*b*)) included in a belt part 32*b* and close to a head part 32*h*, to the bottle body 10 by adhesion, welding or like means.

Hence, it is made possible to maintain the bottle body 10 in the reduced volume state as shown in FIG. 1(*c*) by pull-squeezing the belt part 32*b* in the state of being passed through the head part 32*h* in the same manner as a known tie-wrap, after the bottle body 10 is squeezed and then sealed by the cap 20.

Figure 2:
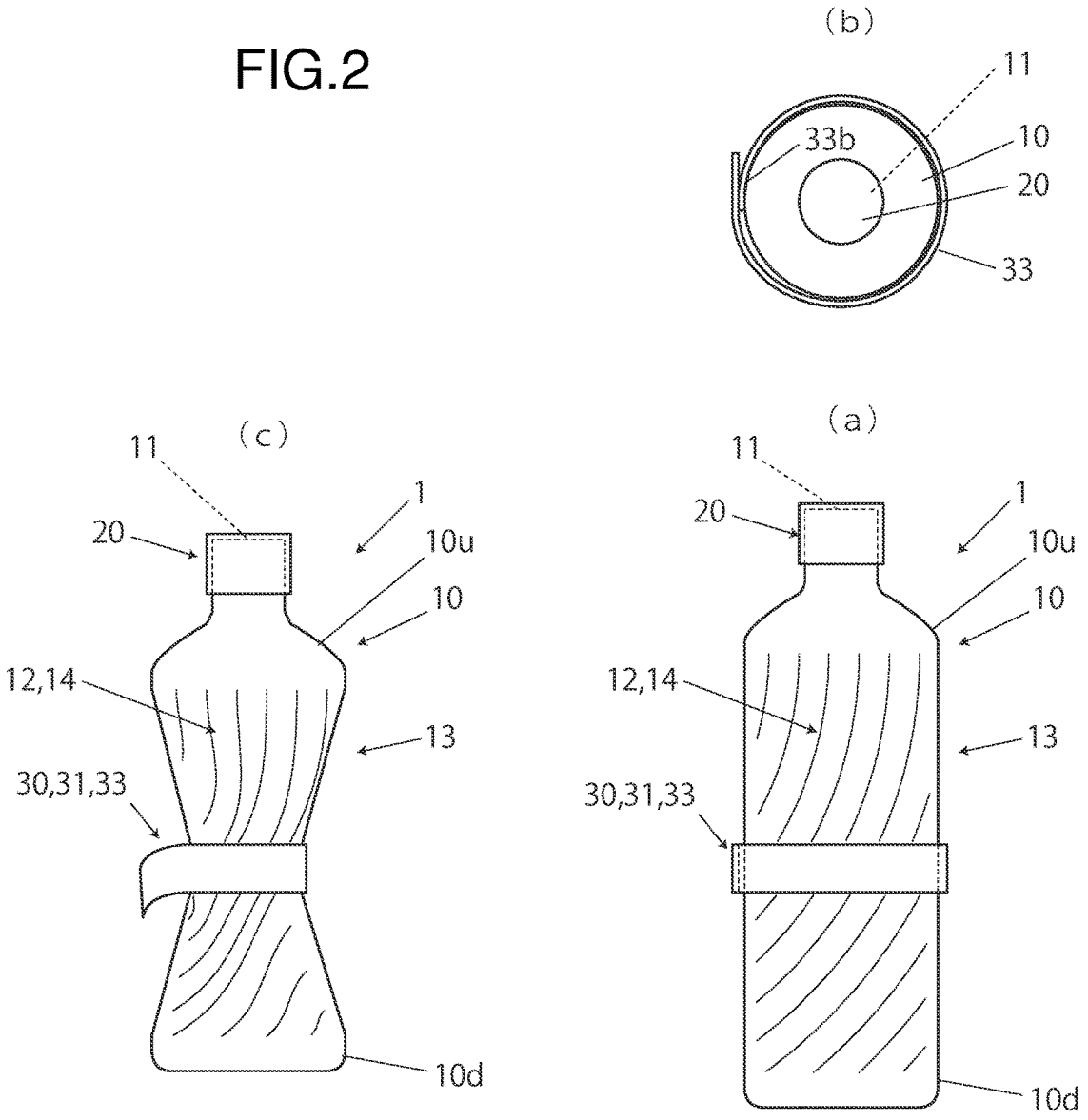
FIG. 2 is a view showing another embodiment of the beverage bottle according to the present invention, wherein FIG. 2(*a*) is a front view, FIG. 2(*b*) is a plan view, and FIG. 2(*c*) is a side view for explaining an action.

Alternatively, as shown in FIG. 2, the squeezing means 31 may be configured also by fixing a portion 33*b* (see FIG. 2(*b*)) of a belt 33 provided with known hook and loop fasteners to the bottle body 10 by adhesion, welding or like means.

In this case, it is made possible also to maintain the bottle body 10 in the reduced volume state as shown in FIG. 2(*c*) by pull-squeezing the belt 33 in the state of being wound around the bottle body 10 and then coupling the hook and loop fasteners with each other in the same manner as a known belt with hook and loop fasteners, after the bottle body 10 is squeezed and then sealed by the cap 20.

Figure 3:
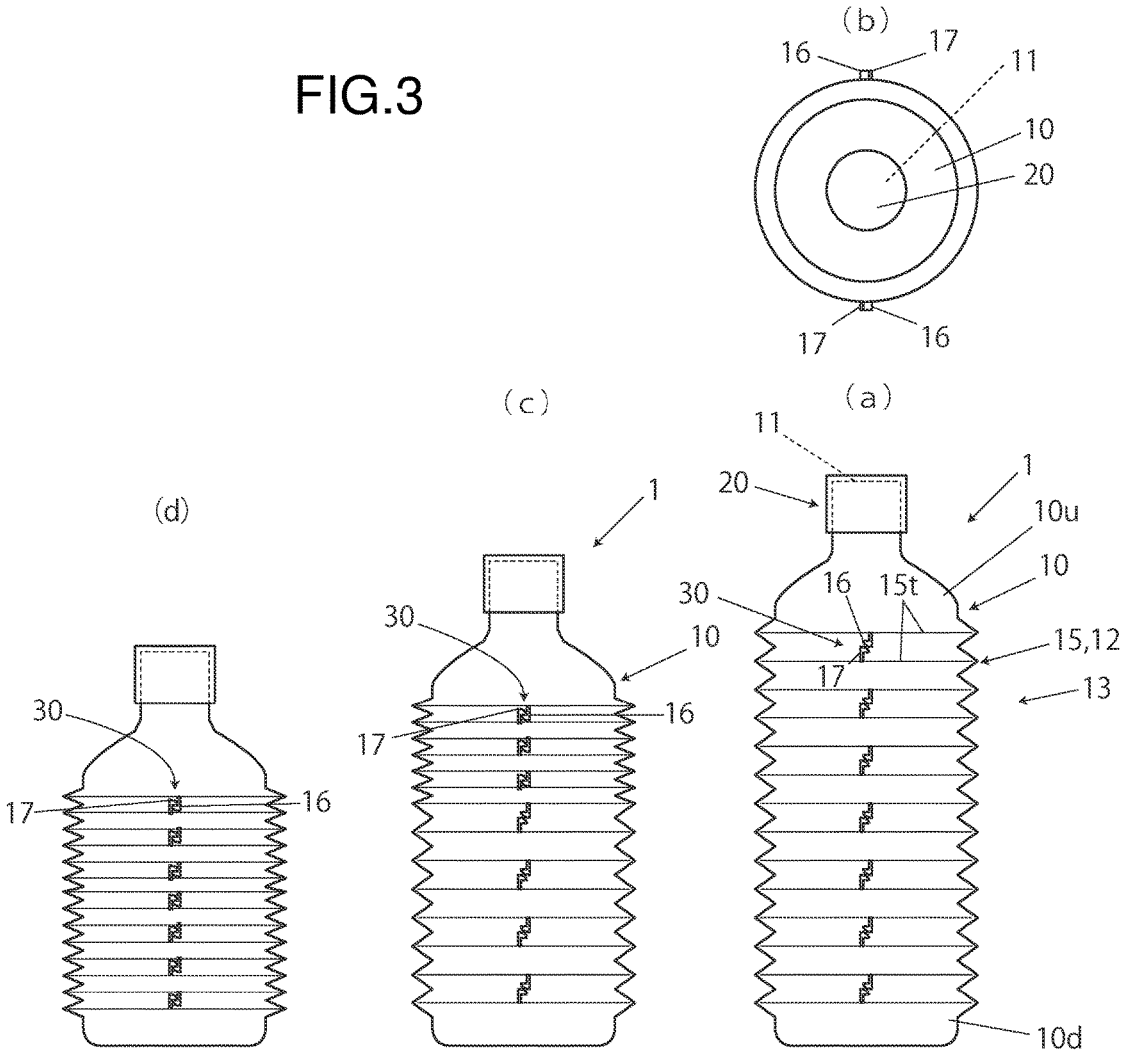
FIG. 3 is a view showing still another embodiment of the beverage bottle according to the present invention, wherein FIG. 3(*a*) is a front view, FIG. 3(*b*) is a plan view, and FIG. 3(*c*) is a side view for explaining an action.

Alternatively, as shown in FIG. 3, the volume-reducing structure 12 may be configured by forming at least the trunk section 13 of the bottle body 10 in a bellows shape, and the shrunken state-maintaining means 30 may be configured with a plural number of mutually engageable hooks 16, 17 respectively provided on angle-part tips 15*t* of a bellows-shaped section 15.

With such a configuration, only an action of shrinking the bottle body 10 along the bellows-shaped section 15 in accordance with the amount of leftover beverage enables the bottle body 10 to be maintained in the reduced volume state in such a manner that the hooks 16, 17 are engaged with each other at the same time that the bottle body 10 is shrunken, as shown in FIG. 3(*c*) or 3(*d*), and as a result, any additional operation for maintaining the shrunken state is eliminated.

In the process of shrinking the bottle body 10 as shown in FIG. 3(*c*) or 3(*d*), the hooks 16, 17 are engaged with each other in such a manner that the tip of one hook and that of the other go over each other by elasticity of each hook and that of the bottle body 10.

The hook 16 in the form of a downward hook and the hook 17 in the form of an upward hook are respectively provided in plural number. With such a configuration, the hooks 16, 17 arranged in proper places corresponding to the reduced volume state of the bottle body 10 come into engagement with each other.

FIG. 3(*c*) shows the state in which the respective three hooks 16, 17 from the top are in engagement with each other in cases where the amount of leftover beverage is comparatively large.

FIG. 3(*d*) shows the state in which all the hooks 16, 17 are in engagement with each other in cases where the amount of leftover beverage is comparatively small.

It is noted that the pitch of the bellows and the number of the hooks 16, 17 may be appropriately set.

The hooks 16, 17 are respectively arranged in more than one place (at least two places (on the surface side and the back side of the page space in FIG. 3, for instance)) about the axis of the bottle body 10. It may be possible also to provide these hooks at spacing of 120 degrees in three places, or alternatively, at spacing of 90 degrees in four places.

The hooks 16, 17 may be formed integrally with the bottle body 10.

Figure 4:
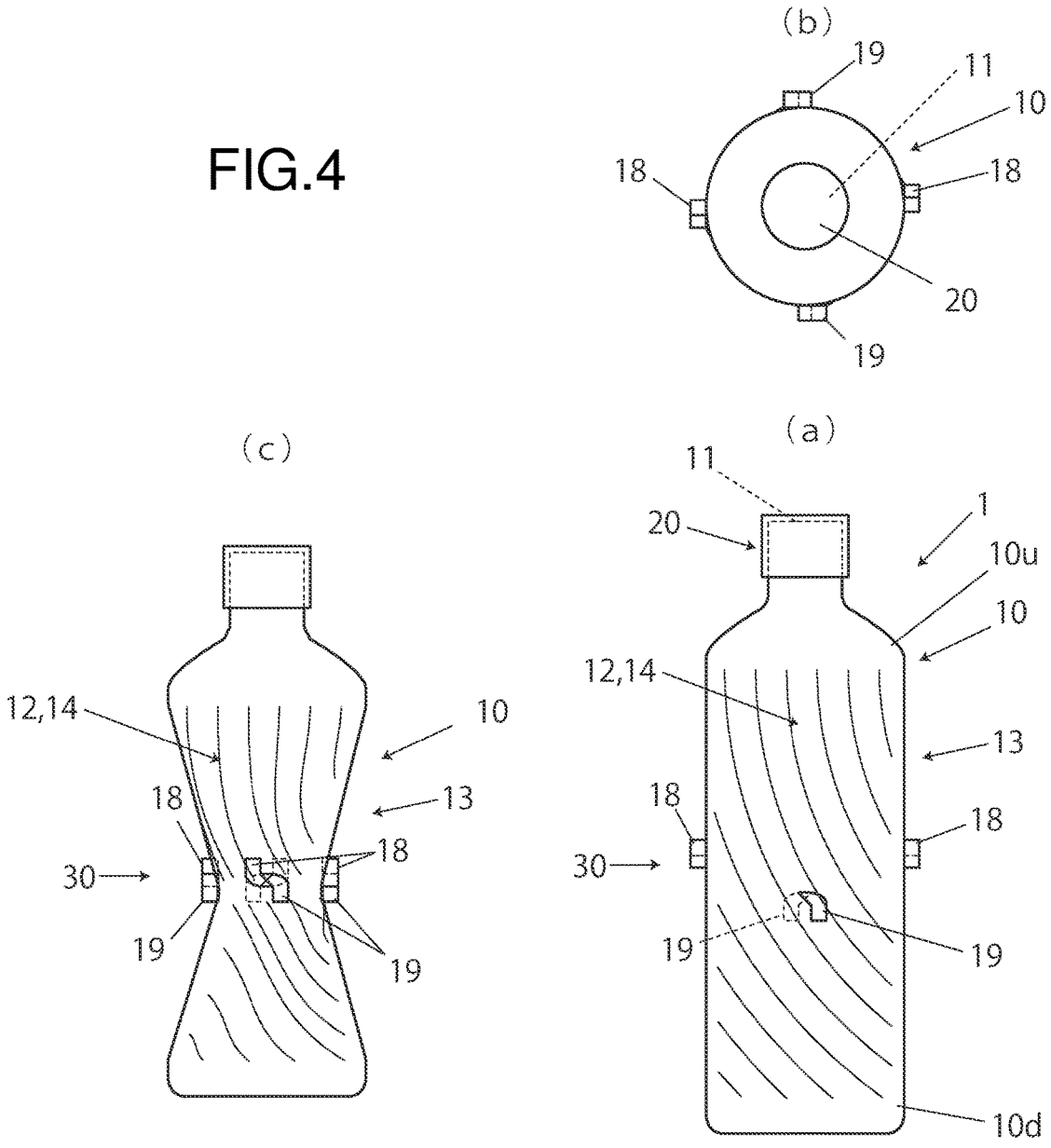
FIG. 4 is a view showing still yet another embodiment of the beverage bottle according to the present invention, wherein FIG. 4(*a*) is a front view, FIG. 4(*b*) is a plan view, and FIG. 4(*c*) is a side view for explaining an action.

Alternatively, as shown in FIG. 4, the volume-reducing structure 12 may be configured of the helical protrusions and recesses 14 respectively formed on the bottle body 10, and the shrunken state-maintaining means 30 may be configured with hooks 18, 19 capable of being engaged with each other at the time when the bottle body 10 is squeezed along the helical protrusions and recesses 14 as shown in FIG. 4(*c*).

With such a configuration, only an action of squeezing the bottle body 10 along the helical protrusions and recesses 14 enables the bottle body 10 to be maintained in the reduced volume state in such a manner that the hooks 18, 19 are engaged with each other at the same time that the bottle body 10 is shrunken, as shown in FIG. 4(*b*), and as a result, any additional operation for maintaining the shrunken state is eliminated.

In the process of shrinking the bottle body 10 as shown in FIG. 4(*b*), the hooks 18, 19 are engaged with each other in such a manner that the tip of one hook and that of the other go over each other by elasticity of each hook and that of the bottle body 10.

The hook 18 in the form of a downward hook and the hook 19 in the form of an upward hook are respectively arranged in more than one place about the axis of the bottle body 10. The hooks 18, 19 shown are those arranged at spacing of 90 degrees in four places.

The hooks 18, 19 may be formed integrally with the bottle body 10.

Although the present invention has been described in its preferred embodiments, it is to be understood that the present invention is not limited to the above embodiments but may be otherwise variously embodied within the scope of the present invention.

EXPLANATION OF REFERENCE NUMERALS

1: Beverage bottle
10: Bottle body
11: Opening
12: Volume-reducing structure
13: Trunk section
14: Helical protrusions and recesses
15: Bellows-shaped section
15*t*: Angle part-tip
16, 17, 18, 19: Hook
20: Cap
30: Shrunken state-maintaining means
31: Squeezing means

The invention claimed is:

1. A beverage bottle comprising:

a bottle body having a volume-reducing structure capable of reducing the volume of the bottle body;

a cap capable of sealing an opening of the bottle body; and a shrunken state-maintaining means provided on said bottle body to cause the bottle body having been reduced in volume to be maintained in the reduced volume state while containing liquid contents, wherein said volume-reducing structure is configured of substantially longitudinal helical protrusions and recesses respectively formed on the bottle body, and said shrunken state-maintaining means is provided on a trunk section of the bottle body at a substantially central longitudinal portion of the trunk section, and is configured with an integral squeezing means for squeezing and maintaining the trunk section having been narrowed by being squeezed along said helical protrusions and recesses, and, wherein said bottle body maintains the shrunken state created thereby, while containing liquid contents.

* * * * *